United States Patent [19]

Herbin et al.

[11] Patent Number: 4,852,631

[45] Date of Patent: Aug. 1, 1989

[54] METHOD AND APPARATUS FOR FIXING A METAL BLOCK ON A FACE OF AN OPHTHALMIC LENS, BY CASTING MOLTEN METAL THEREON

[75] Inventors: Patrick Herbin, Morlaincourt; Jean-Claude Lacroix, Ligny-en-Barrois, both of France

[73] Assignee: Essilor International (Compagnie Generale d'Optique), Creteil, France

[21] Appl. No.: 173,292

[22] Filed: Mar. 25, 1988

[30] Foreign Application Priority Data

Mar. 30, 1987 [FR] France ..... 87 04376

[51] Int. Cl.[4] ..... B22D 19/04; B22D 35/00

[52] U.S. Cl. ..... 164/98; 164/133

[58] Field of Search ..... 164/133, 98, 337, 457, 164/155, 156, 332

[56] References Cited

U.S. PATENT DOCUMENTS 2,660,769 12/1953 Bennett ..... 164/337
3,049,766 8/1962 Buckminster ..... 164/4.1
3,605,863 9/1971 King ..... 164/156
4,025,033 5/1977 Hodges ..... 164/332

FOREIGN PATENT DOCUMENTS 1384277 11/1964 France .

*Primary Examiner*—Kuang Y. Lin
*Attorney, Agent, or Firm*—Oblon, Spivak, McClelland, Maier & Neustadt

[57] ABSTRACT

In this blocking apparatus, at least a portion of the pipe connecting the inlet orifice of the mold to the outlet orifice of the tank containing molten metal is in thermal contact with the mold, which mold includes at least one channel through which a cooling fluid can be caused to flow. Heater means are also associated with the pipe. Thus, the flow of molten metal from the tank into the mold can be stopped by allowing a plug of solidified metal to form in the pipe when the mold is cooled, and the flow of molten metal can be re-established by melting the plug of solidified metal by use of the heater means.

1 Claim, 1 Drawing Sheet

METHOD AND APPARATUS FOR FIXING A METAL BLOCK ON A FACE OF AN OPHTHALMIC LENS, BY CASTING MOLTEN METAL THEREON

FIELD OF THE INVENTION

The present invention provides a method of fixing a metal block on a face of an ophthalmic lens, the method consisting in: providing a mold which, together with the lens itself, defines a mold cavity, the mold having a mold inlet orifice; providing a tank containing molten low melting point metal, the tank being connected to the mold inlet orifice via a pipe, admitting molten metal into the mold cavity via the mold inlet orifice and the pipe; and cooling the mold in order to solidify the molten metal admitted into the mold cavity.

BACKGROUND OF THE INVENTION

In the manufacture and preparation of ophthalmic lenses, it is common practice to fix a block of metal on one of the faces of a lens, thereby enabling the lens to be mounted on a lens holder in a surfacing machine, in an edging machine, or in a polishing or clear-polishing machine. This operation, which is referred to as "blocking", is normally performed by means of a blocking apparatus comprising a mold having an open mold cavity and an inlet orifice formed through a wall of the mold and opening out into the mold cavity, together with a tank containing a molten metal and including an outlet orifice for the molten metal.

In prior blocking apparatuses (see for example French patents numbers 1 507 454 and 2 465 562; and U.S. Pat. Nos. 3,049,766, 3,118,198, 3,237,349, 3,257,686, 3,468,366, 3,563,301, 4,025,033, and 4,136,727; and British patent number 1 297 037), the mold is conventionally filled with molten metal either by casting the metal into the mold under gravity or else by pumping the metal by means of a pump, generally a handactuated pump, or else by delivering the metal into the mold by putting the tank under pressure using compressed air. The flow of molten metal into the mold is usually controlled either by a cock or moving peg associated with an outlet orifice from the tank, or else by a valve placed in the pipe connecting the tank to the mold. In operation, such flow control devices are subject to breakdowns due to the fact that their moving parts are at least partially immersed in or in contact with molten metal and therefore operate under severe conditions. Further, during periods of inactivity, it may happen that the molten metal in the blocking apparatus solidifies in the vicinity of the moving parts or downstream therefrom, thus jamming the moving parts or creating an obstruction preventing any subsequent flow of molten metal to the mold.

OBJECT OF THE INVENTION

The object of the present invention is thus to provide a method of fixing a metal block on a face of an ophthalmic lens in which the means used for controlling the flow of molten metal to the mold are entirely static and are, consequently, reliable.

SUMMARY OF THE INVENTION

To this end, the present invention provides a method as defined above and containing the improvement of: ensuring that at least a portion of the pipe is also cooled when the mold is cooled in order to form a plug of solidified metal in that portion of the pipe; separating the block of solidified metal in the mold cavity from the plug of metal solidified in the pipe by forcibly ejecting the metal block together with the lens attached thereto out from the mold cavity while leaving the plug or solidified metal in the pipe; and refilling the mold cavity by heating at least that portion of the pipe in order to melt the plug of solidified metal.

The invention also provides blocking apparatus for fixing a metal block on a face of an ophthalmic lens, the apparatus comprising: a tank containing a molten metal and having an outlet orifice for the molten metal; a mold having an open mold cavity and an inlet orifice for receiving the molten metal, the mold including at least one cooling channel in which a cooling liquid may be caused to flow; a pipe connecting the tank outlet orifice to the mold inlet orifice, at least a portion of the pipe being in thermal contact with the mold; and heater means associated with the pipe.

In a preferred embodiment of the invention, the pipe is made of an electrically conductive metal, and the heater means is constituted by a low voltage high current electricity source, the source being electrically connected to the ends of the conductive pipe. Preferably, the inlet orifice to the mold is tapering in shape with its small end being situated adjacent to the mold cavity and with its large end being situated adjacent to the pipe.

BRIEF DESCRIPTION OF THE DRAWING

An embodiment of the invention is described by way of example with reference to the accompanying drawings, in which.

MORE DETAILED DESCRIPTION

Figures 1, 2:
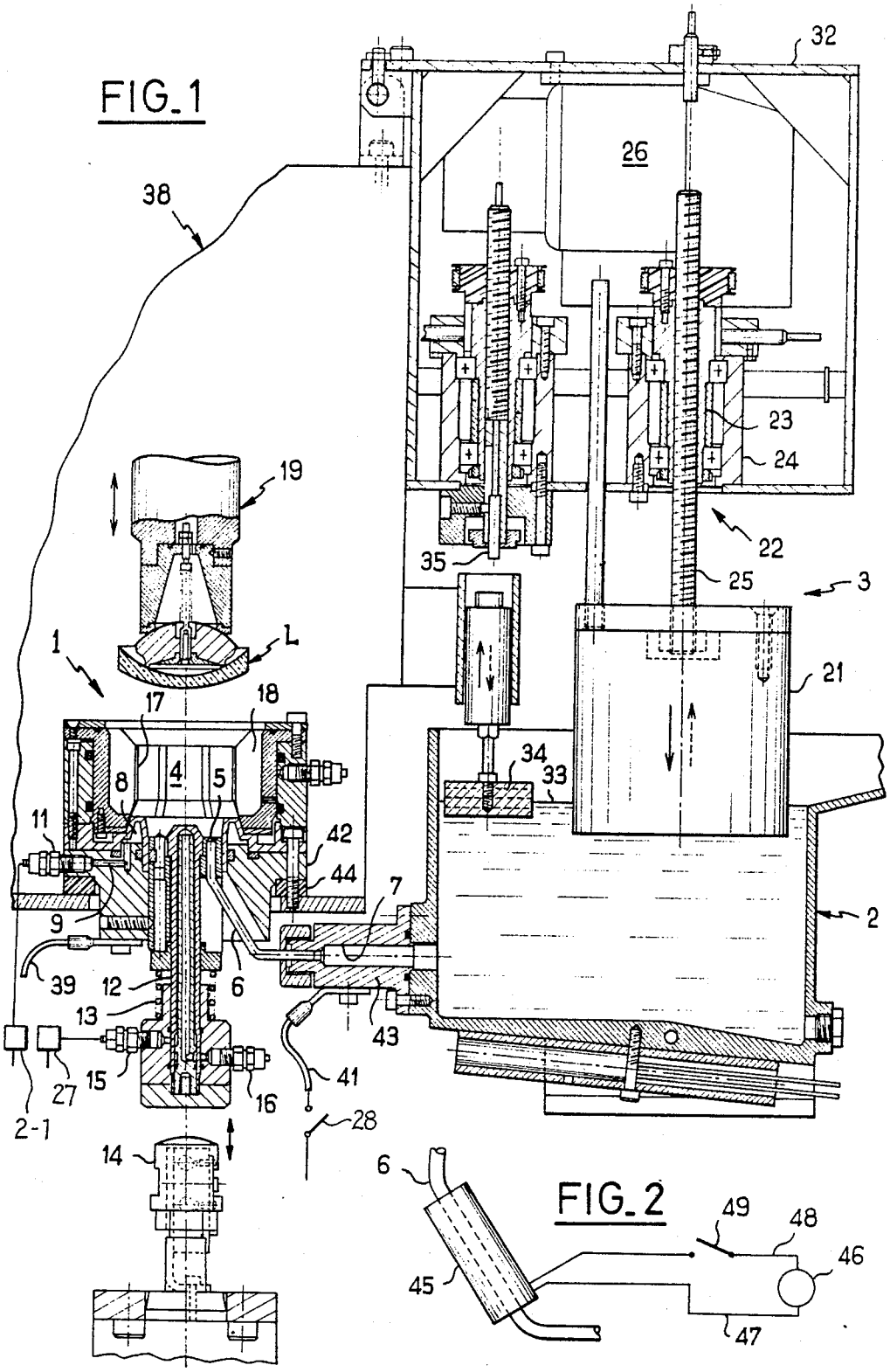
FIG. 1 is a vertical section through a blocking apparatus in accordance with the present invention.
FIG. 2 is a larger scale view of a variant embodiment of a portion of the FIG. 1 blocking apparatus.

The blocking apparatus shown in FIG. 1 may constitute a subassembly of a more complex machine for preparing and blocking ophthalmic lenses. It comprises a mold 1, a tank 2 which is heated in conventional manner and which contains molten metal, and a level adjusting device 3 for adjusting the level of the molten metal contained in the tank 2.

The mold 1 comprises a mold cavity 4 which is upwardly open and which has an inlet orifice 5 in the bottom thereof for admitting molten metal, which orifice is connected by a pipe 6 to an outlet orifice 7 from the tank 2.

The mold 1 may be cooled in conventional manner by a cooling fluid, for example cold water. To this end, the bottom of the mold cavity 4 in the mold 1 includes an annular channel 8 into which cold water may be admitted via a passage 9 connected via a connector 11 and a pipe (not shown) to a source of cold water, with the water leaving the channel 8 via another passage and another connector (not shown) similar to the passage 9 and the connector 11.

The mold 1 further includes, in conventional manner, an ejector rod 12 which is movable vertically and which is normally maintained in a low position by a spring 13, but which may be displaced to a high position against the return force of the spring 13 by a pusher 14 which may be actuated, for example, by means of a pneumatic actuator. The ejector rod 12 may also be cooled by a cooling fluid such as cold water which may be admitted into cooling channels in the rod 12 via a connector 15 and which may be removed therefrom via a connector 16.

Although the general structure of the mold may be similar to any prior art mold used for blocking ophthalmic lenses, it is preferably a mold as described in the Applicant's co-pending U.S. patent application Ser. No. 07/173,295 filed Mar. 25, 1988 entitled "A mold for fixing a metal block on one of the faces of an ophthalmic lens". Briefly, the mold cavity 4 has an inside diameter which is greater than the greatest existing diameter of ophthalmic lens, together with a generally cylindrical membrane 17 made of an elastically deformable substance such as latex, for example, which is disposed concentrically inside the cavity 4. The top and bottom ends of the membrane 17 are fixed to the mold 1 respectively near to the bottom of the cavity 4 and near to the opening of the cavity 4. The membrane 17 together with the side wall of the mold defines a variable volume chamber 18 such that the inside diameter of the membrane 17 can be increased or decreased at will, for example by evacuating the chamber 18 and then restoring atmospheric pressure in the chamber 18. Thus, when the membrane 17 occupies its maximum inside diameter position, a lens L supported by a suitable transfer device 19 known per se, can easily be inserted and held in the mold cavity 4 by the transfer device 19. The membrane 17 is then put into a minimum inside diameter posititon, thereby elastically tightening around the peripheral edge of the lens L while the mold cavity 4 is filled with molten metal as described below.

As can be seen in FIG. 1, the level adjusting device 3 is constituted by a plunger 21 suitable for being vertically displaced inside the tank 2 by actuator means 22 e.g., a mechanism comprising a screw 25 and a nut 23 which is rotatable in both directions of rotation by a motor and step-down gear unit 26. Thus, depending on the direction of rotation of the motor, the plunger 21 may be lowered inside the tank 2 in order to raise the level 33 of molten metal contained in the tank 2, or else it may be raised in order to lower the level 33.

Initially, the level of molten metal inside the tank 2 is lower than the inlet orifice 5 to the mold 1. After a first lens has been inserted in the mold 1 in the manner described above by the transfer device 19, the level 33 of molten metal in the tank 2 is raised by displacing the plunger 21 downwards using the actuator means 22 and the motor and step-down gear unit 26. As a result, the mold cavity 4 is filled with molten metal since it is in communication with the tank, and the level of molten metal in the mold cavity 4 is the same as the level in the tank 2. In order to ensure that the molten metal inside the mold cavity 4 reaches the desired level (i.e., in order to ensure that the bottom face of the lens L is completely immersed in the molten metal), it is necessary merely to control the level 33 of the molten metal in the tank 2. This can be done by means of a float 34 supported by the molten metal in the tank 2 and by means of a detector 35 mounted in a fixed position which can be adjusted. The detector 35 produces a signal having a first state when the float 34 is at a level which is less than a predetermined level corresponding to the desired level of molten metal inside the cavity 4, and a second state when the float 34 reaches the predetermined level. The detector 35 which may be a proximity detector of any conventional type (e.g., an inductor detector), is electrically connected to a circuit for controlling the motor and step-down gear unit 26 so as to activate it to displace the plunger downwards in response to the first state of the signal from the detector and to cause it to stop in response to the second state of the detector signal.

Once the mold cavity 4 has been filled with molten metal, it is cooled in order to solidify the metal block contained in the mold cavity. Although this cooling operation could be performed by allowing the mold 1 to cold naturally, the mold is preferably cooled by causing a cole fluid (e.g., cold water) to flow through the cooling channel 8 and through the cooling channel of the ejector rod 12 as described above, thereby accelerating cooling and solidification of the metal contained in the mold cavity 4.

Preferably, the pipe 6 is made of a material which is a good conductor of heat, and at least that portion of the pipe 6 which is adjacent to the inlet orifice 5 of the mold 1 is in thermal contact with the mold body 45. Consequently, when the body 45 is cooled by the cooling fluid flowing in the channel 8 and in the cooling channel of the ejector rod 12, that portion of the pipe 6 is also cooled, and a plug of solidified metal is formed therein.

After evacuating the variable volume chamber 18 in order to incnease the inside diameter of the cylindrical membrane 17 and move it away from the peripheral edge of the lens L, the metal block and the lens L attached thereto are ejected from the mold cavity 4 and are taken away by the transfer device 19, while the plug of solidified metal is retained in the pipe 6. The plug of solidified metal remains in the pipe 6 firstly because the pipe is curved, and secondly because the inlet orifice 5 to the mold 1 is preferably tapering in shape with the small end of the taper being situated adjacent to the mold cavity 4 and the large end adjacent to the pipe 6. This tapering shape facilitates breaking and separtion between the block of metal that has solidified inside the mold cavity and the plug of metal solidified inside the pipe 6 under the action of the ejector rod 12. After the lens L has been removed from the mold cavity 4, there thus remains a plug of solidified metal in the pipe 6. This prevents the molten metal from penetrating into the mold cavity 4 even if the level of the molten metal in the tank 2 is kept above the level of the inlet orifice 5 of the mold 1 (i.e. even if the plunger 21 is not raised).

When another lens is inserted in the mold cavity 4 in order to have a metal block fixed thereon, it is therefore necessary to melt the plug of solidified metal in the pipe 6 in order to refill the mold cavity with molten metal. To this end, the cooling fluid flow is stopped in the channel 8 and also in the cooling channel of the ejector rod 12. Heater means associated with the pipe 6 are activated. In the embodiment shown in FIG. 1, the pipe 6 is made of an electrically conductive metal (e.g., copper), and its ends are electrically connected to a suitable current source for example, a low voltage high current (e.g. 3 V and 400 A). The electrical connection between the pipe 6 and the voltage supply may be provided, for example, by means of two conductors 39 and 41 fixed respectively to the body 42 of the mold 1 and to the outlet nozzle 43 of the tank 2, with the two components 42 and 43 being made of electrically conductive material and being in electrical contact with the ends of the pipe 6. The mold 1 and the tank 2 are electrically insulated from the frame 38 of the apparatus by suitable insulating fittings e.g., the gasket 44 shown in FIG. 1 adjacent to the mold 1.

Thus, when the voltage provided by the voltage source is applied to the ends of the pipe 6 by closing an appropriate switch, the pipe 6 and the metal contained therein are heated by the Joule effect, thereby melting the plug of solidified metal present in the pipe 6. The mold cavity 4 can then be refilled with molten metal in a manner similar to that described above.

Instead of heating the pipe 6 by passing an electric current therealong, it is naturally possible to use other heater means. For example, as shown in FIG. 2, a heater element 45 could be disposed around the pipe 6 and electrically connected to an appropriate voltage supply 46 by conductors 47 and 48 and via a switch 49. The heater element 45 could be constituted by an electrical heater resistance or by an induction coil. If an induction coil is used, the induction coil constitutes the primary of a transformer whose secondary is formed by the pipe 6 and/or by the metal contained therein, with the electrical energy induced in the secondary of the transformer being entirely dissipated in the form of heat by the Joule effect within the pipe 6 and/or the metal contained therein.

It may be observed that, by voluntarily causing a plug of solidified metal to be formed in the pipe 6 by cooling the mold 1 and by cooling the pipe 6, and by using heater means associated with the pipe 6 in order to melt the plug. Of solidified metal, it is possible to control the flow of molten metal into the mold 1 at will without making use of any moving closure member such as those required in prior art blocking apparatuses.

Naturally the embodiment of the invention described above has been given purely by way of non-limiting example, and numerous modifications can easily be made thereto by the person skilled in the art without going beyond the scope of the invention. Thus, in order to raise the level 33 of the molten metal in the tank 2, it is possible to displace the tank 2 itself vertically instead of using a plunger 21. If the tank 2 is displaced vertically, and assuming that the actuator means 22 is appropriately dimensioned, the screw 25 may be attached to the tank 2 instead of being attached to the plunger 21. Additionally, in this case, at least a portion of the pipe 6 must be flexible.

We claim:

1. A metehod of fixing a metal block on a face of an ophthalmic lens, said method comprising the steps of:

(a) providing a mold which, together with the lens itself, defines a mold cavity, said mold having a mold inlet orifice;

(b) providing a tank containing molten low melting point metal, said tank being connected to said mold inlet orifice via a pipe;

(c) admitting molten metal into said mold cavity via said mold inlet orifice and said pipe;

(d) cooling said mold in order to solidify the molten metal admitted into said mold cavity;

(e) cooling at least a portion of said pipe when said mold is cooled in order to form a plug of solidified metal in said portion of said pipe;

(f) separating the block of solidified metal in said mold cavity from the plug of metal solidified in said pipe by forcibly ejecting the block of solidified metal together with the lens attached thereto from said mold cavity while leaving the plug of metal solidified in said pipe; and (g) refilling said mold cavity by heating at least said portion of said pipe in order to melt the plug of metal solidified in said pipe.

* * * * *